US009469447B2

(12) United States Patent
Zacchi

(10) Patent No.: US 9,469,447 B2
(45) Date of Patent: Oct. 18, 2016

(54) SEALING MECHANISM FOR PACKAGING CONTAINERS

(71) Applicant: Luca Zacchi, Verbania (IT)

(72) Inventor: Luca Zacchi, Verbania (IT)

( * ) Notice: Subject to any disclaimer, the term of this patent is extended or adjusted under 35 U.S.C. 154(b) by 0 days.

(21) Appl. No.: 14/388,919

(22) PCT Filed: Mar. 27, 2013

(86) PCT No.: PCT/IT2013/000090
§ 371 (c)(1),
(2) Date: Sep. 29, 2014

(87) PCT Pub. No.: WO2013/144988
PCT Pub. Date: Oct. 3, 2013

(65) Prior Publication Data

US 2015/0083726 A1 Mar. 26, 2015

(30) Foreign Application Priority Data

Mar. 28, 2012 (IT) ..... MN2012A0006

(51) Int. Cl.
*B65D 43/22* (2006.01)
*B65D 55/02* (2006.01)
(Continued)

(52) U.S. Cl.
CPC ..... *B65D 43/22* (2013.01); *B65D 55/024* (2013.01); *G09F 3/03* (2013.01); *B65D 81/3816* (2013.01); *B65D 2211/00* (2013.01)

(58) Field of Classification Search
CPC B65D 43/22; B65D 55/024; B65D 2211/00; B65D 81/3816; G09F 3/03
USPC ..... 220/315, 324, 316, 317, 318, 319, 320, 220/321, 322, 323, 325, 326, 327, 328; 190/118; 292/336.3, DIG. 38
See application file for complete search history.

(56) References Cited

U.S. PATENT DOCUMENTS 3,816,882 A 6/1974 Maeda et al.
4,270,668 A * 6/1981 Berfield ..... 220/324
4,782,977 A 11/1988 Watanabe et al.
(Continued)

FOREIGN PATENT DOCUMENTS

EP 0 658 486 6/1995
GB 2 358 377 7/2001

OTHER PUBLICATIONS

International Search Report dated Aug. 1, 2013, corresponding to PCT/IT2013/000090.

*Primary Examiner* — Robert J Hicks
*Assistant Examiner* — Kareen Thomas
(74) *Attorney, Agent, or Firm* — Young & Thompson

(57) ABSTRACT

A sealing mechanism for packaging containers offers the end recipient a way of testing and guaranteeing that the container has not been tampered with or opened during transport operations, and that it has reached its destination in the same condition as when it left. The sealing mechanism for packaging containers of the "low-coefficient" type includes a first and second pin for engaging with a relative seat present on the edge of the container, and a tab designed to fit into the space between the pins. The mechanism for packaging containers of the "high-coefficient" type features, a plate as a first component envisaged to fit into a relative seat present in the container, a second component including an opening block and a fitting designed to engage with the lid of the container, and a pin envisaged to engage with the first component and the second component, securing the entire mechanism.

11 Claims, 5 Drawing Sheets

(51) Int. Cl.
*G09F 3/03* (2006.01)
*B65D 81/38* (2006.01)

(56) References Cited

U.S. PATENT DOCUMENTS 5,193,707 A * 3/1993 Mizumura ..... 220/326
5,328,046 A 7/1994 Kutz et al.
5,385,257 A * 1/1995 Hung ..... B65D 45/24 220/315
5,738,238 A * 4/1998 Yang ..... B65D 45/24 16/267

* cited by examiner

SEALING MECHANISM FOR PACKAGING CONTAINERS

The present invention relates to a sealing mechanism for packaging containers, particularly suitable to offer the end recipient a means of monitoring and guaranteeing that the container has not been tampered with or opened during transport operations, which could result in the risk of deterioration of the products contained therein, or of theft, and that it has reached its destination in the same condition as when it left.

BACKGROUND OF THE INVENTION

As is known, the transportation of delicate substances, such as, for example, foodstuffs but also and especially pharmaceutical products, has uncovered a plurality of problems which may result in the integrity of the items transported being put at risk. Indeed, the transport of perishables and delicate products such as, for example, drugs, medicines and substances that need to be handled and transported using secure, protected means offering insulation against the surrounding environment, requires particular containers, preferably made of polystyrene.

At present, the container—once the products are arranged therewithin—is closed with a lid and sealed with tape that closes up the gap between the container and the lid.

The tape used is standard adhesive tape which can be easily removed, therefore, it can happen that the contents are purloined (either entirely or in part, especially when such contents are drugs or precious substances) and the container closed again, with the tampering or theft only noticed when it reaches the recipient, resulting in great economic damage for the recipient and embarrassment for the logistics company handling the shipment.

Another drawback encountered stems from the fact that the adhesive tape is placed on the container manually, which means time is wasted during the management of shipments and shipment management costs are increased as result of the processing costs, comprising the costs of the adhesive tape and the cost of the worker designated to carry out this process.

Currently, the tape is classified as a non-recyclable material which must be disposed of separately from the container, which is—instead—totally recyclable. Moreover, it can happen that the tape does not always detach perfectly from the container when opened and pieces thereof remain attached, which means the container must also undergo separate disposal, resulting in the partial loss of material (because partly polluted) which would otherwise be usable.

In addition, it can happen that, when removing the tape, the polystyrene of the container is ruined and is no longer reusable and must be discarded.

In particular, when transporting drugs, a whole series of precautions and measures are required to ensure the drugs reach destination intact and in proper storage conditions.

Indeed, it is known that, as a rule, pharmaceutical manufacturers do not ship the drugs directly to their customers; instead, they use pharmaceutical logistics companies which, in turn, are divided into diverse levels, ending in the van that performs on-demand deliveries to individual pharmacies, hospitals, laboratories, etc.

In particular, a drug must be transported applying a whole series of measures and precautions so that it reaches its destination in perfect storage condition, with reference to both the packaging and the contents.

In fact, it is known that a drug which is damaged for various reasons, during the various handling phases, may lose all of its features, becoming an ineffective or even toxic drug, and therefore subject to claims from buyers (pharmacies, hospitals, etc.).

In addition, the drugs must be protected so that the packaging and preparations are not damaged or altered since these items are very expensive to prepare and their disposal (if necessary) is particularly onerous, since they are composed of highly polluting substances.

Finally, the drugs also have to be discarded when the packs are worn, dented, wet, etc., resulting in claims from buyers against the pharmaceutical logistics companies which handle the packing and transportation.

As mentioned previously, the strong need expressed by logistics companies, drug manufacturers, and recipients is to have a container which is sealed in a way which is both secure and at the same time easy and practical to open and close, as well as being not easily tampered with.

In fact, with the current sealing systems there is no certainty that a container cannot be purloined or tampered with, with the theft of the contents thereof, since the contents become accessible and removable by simply cutting or break the tape.

SUMMARY OF THE INVENTION

The aim of the present invention is essentially to solve the problems of the known technique by overcoming the difficulties described above by means of a sealing mechanism for packaging containers which can offer mechanical sealing of the containers which is secure and functional.

A second aim of the present invention is to provide a sealing mechanism for packaging containers which is completely recyclable.

A third aim of the present invention is to provide a sealing mechanism for packaging containers which can enable prevention of purloinment of the contents and/or tampering with the container, guaranteeing to the end user that the container has not been altered or opened during transportation.

A further aim of the present invention is to provide a sealing mechanism for packaging containers which makes the packaging and closing phases fast, simple, and secure, and with features including practicality, tightness, and security.

A still further aim of the present invention is to have a sealing mechanism for packaging containers which acts as a guarantee seal to protect the container.

A still further aim of the present invention stems from the fact that the sealing mechanism for packaging containers can be easily replaced in order to reuse the container several times.

A further but not final aim of the present invention is to provide a sealing mechanism for packaging containers which is easy to manufacture and works well.

These aims and others besides, which will better emerge over the course of the present description, are essentially achieved by means of a sealing mechanism for packaging containers, as outlined in the claims below.

BRIEF DESCRIPTION OF THE DRAWINGS

Further characteristics and advantages will better emerge in the detailed description of a sealing mechanism for packaging containers according to the present invention, provided in the form of a non-limiting example, with reference to the accompanying drawings, in which.

DETAILED DESCRIPTION OF THE PREFERRED EMBODIMENTS

Figures 1, 2, 3, 4:
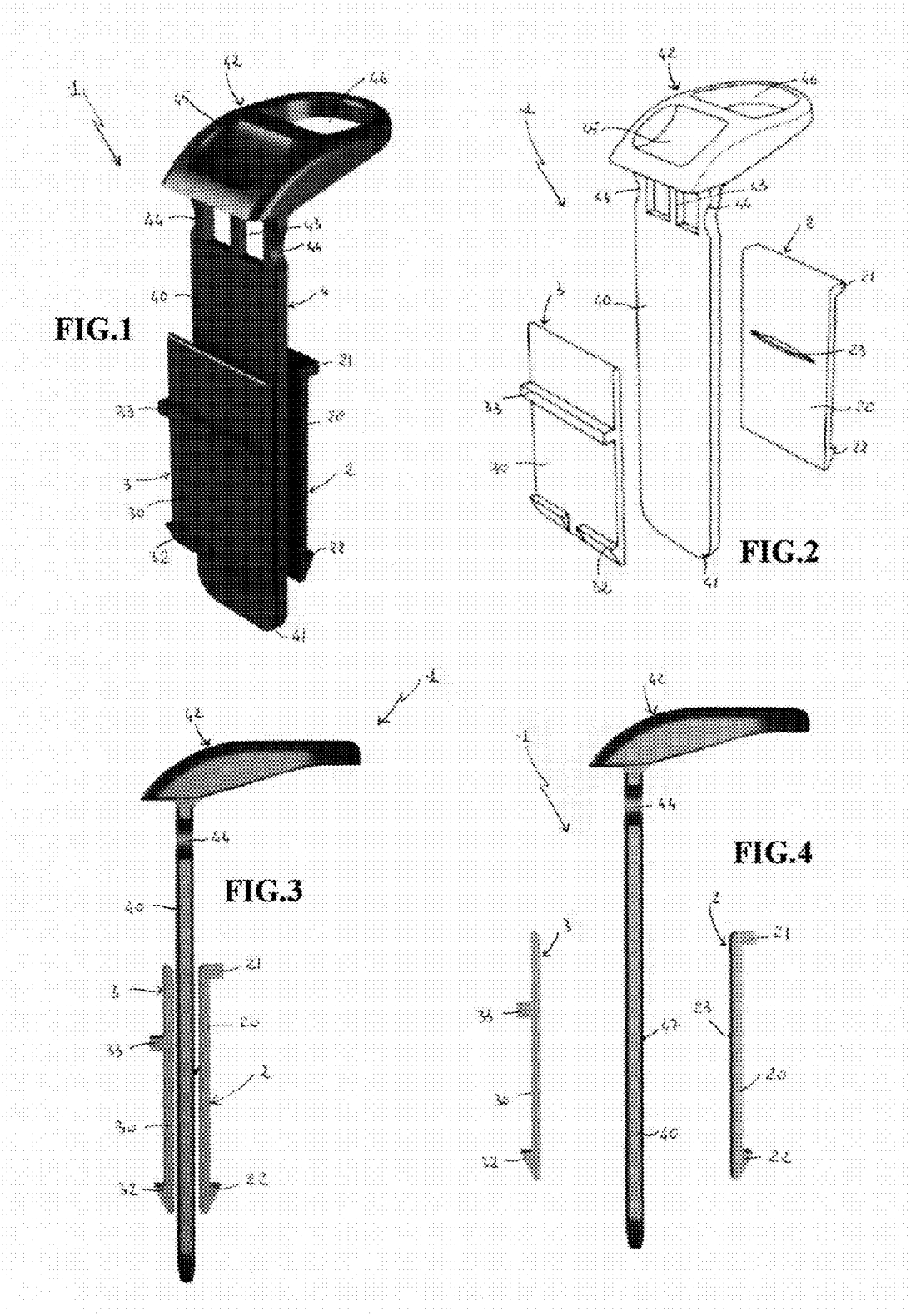
FIG. 1 shows, schematically and from a perspective view, a first sealing mechanism for packaging containers concerned by the present invention.
FIG. 2 shows a perspective and exploded view of the mechanism in FIG. 1.
FIG. 3 shows a side view of the mechanism in FIG. 1 in the operating condition.
FIG. 4 shows a side view of the mechanism in FIG. 1 in the resting condition.

With reference to the aforesaid figures, and in particular to FIG. 1, 1 notes a sealing mechanism for packaging containers as a whole, according to the present invention, which is arranged to be used to close, in a securely and monitorable way, containers which contain delicate products such as, for example, packs of drugs which must be transported in protected conditions.

The first sealing mechanism for packaging containers in question is particularly suitable for polystyrene containers defined as 'low-coefficient' and disposable. In particular, the low-coefficient container falls into the low-cost category, which means it is of the disposable type, since its reuse is not worthwhile financially.

The first mechanism is made of crystal polystyrene, which means it can be disposed of together with the container and both are completely recyclable.

According to the present invention and as shown in FIG. 2, the first mechanism 1 essentially consists of a first pin 2, a second pin 3, envisaged to engage in a suitable seat present on the edge of the container, and a tab 4 arranged to fit within the space between the two pins 2 and 3. In the present embodiment, the first pin 2 is composed of a plate 20 wherein, at one end thereof, there is an edge 21 positioned in an orthogonal manner to the plate, envisaged to rest on the internal edge of the container, as will be better illustrated later, and—at the other end thereof—there is at least one tooth 22 having a wedge-shaped configuration, located on the same side of the edge 21 and envisaged to engage with the container. Furthermore, the plate 20 has at least one rib 23 arranged transversely to the said plate.

The second pin 3 is composed of a plate 30, at one end of which there is at least one tooth 32 having a wedge-shaped configuration and envisaged to engage with the container. Furthermore, the pin 3 can be endowed with at least one rib of the type present on the pin 2. The second pin 3 is also endowed with a lug 33 envisaged to rest on the external edge of the container and located in correspondence with approximately one third of the plate 30 on the same side as the free end, as shown in FIG. 3. In more detail, the free portion 31 of the plate 30 is envisaged to create a protection device for the mechanism so that a sharp element cannot be inserted into the gap between the container and the lid in an attempt to cut the tab 4 and open the container.

Figure 10:
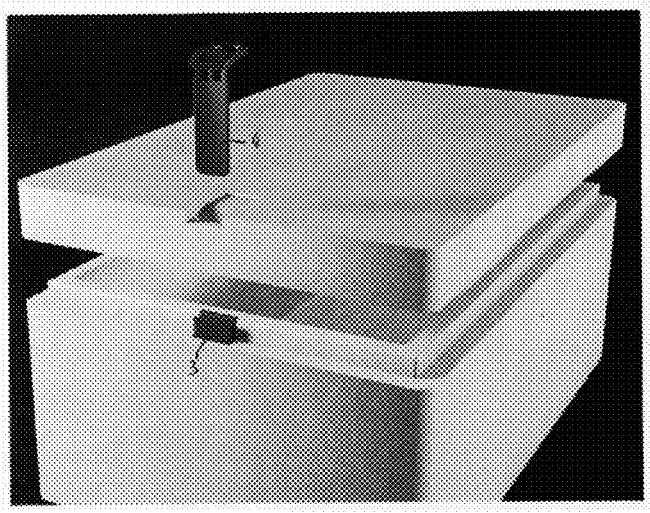
FIG. 10 shows the sealing phase of a container equipped with the mechanism in FIG. 1.

In accordance with the present invention, the tab 4 consists of a strip 40 which features, at one end thereof, corners 41 which are rounded to allow smooth entry between the two pins 2 and 3, as will be illustrated later, and at the other end thereof, a handgrip 42 positioned orthogonally to the strip and envisaged to rest on the lid of the container, as shown in FIG. 10.

In more detail, between the handgrip 42 and the strip 40 there is a rupture element consisting of a central pin 43 and at least two lateral pins 44, which have a slightly tapered external edge.

In addition to the explanations so far, the handgrip 42 is endowed, at the top thereof, with a small loop 45 designed to create a housing for a user's finger, which has a convenient seat in order to be able to exert enough pressure to allow the tab to be inserted between the two pins 2 and 3. Furthermore, the handgrip 42 also includes a slot 46, envisaged to accommodate the user's finger when the container must be opened, in order to be able to exert enough force to break the pins 43 and 44 to be able to slide out the container lid secured in place by the presence of the tab 4.

Moreover, as shown in FIG. 4, the tab 4 features at least one rib 47 positioned transversely to the said strip and envisaged to abut with the rib 23 on the first pin 2. This rib 47 is located approximately a quarter of the way along the strip on the same side as the rounded corners 41. The tab 4 may feature the rib 47 on one side or on both sides.

In particular, all the surfaces of the first pin 2, the second pin 3, and the tab 4 are rough to create friction when they are in contact with the walls of the container and also reciprocally. In addition to the information disclosed so far, during the implementation phase, the pins 2 and 3 are joined together and folded for insertion into the seat of the container or are separate.

As mentioned previously, the first mechanism is preferably used with containers which feature thin walls, classed as 'low-coefficient'.

In more detail, the container has a pair of seats designed to accommodate, in the interior thereof, the two pins which are inserted into the seat coupled together and positioned with the teeth 22 and 32 facing towards the exterior. The pin 2 lowers into the seat until the edge 21 abuts with the internal edge of the container while the pin 3 lowers until the lug 33 abuts with the external edge of the container, which is lower.

At this point, after being filled with the objects which must be transported, the container can be closed with the lid, which features a slot in correspondence with the seat on the container to allow the tab 4 to be inserted first into the slot, lowering it until it fits between the two pins, as shown in FIG. 10. In particular, the pin 3 which abuts with the external side is positioned in a slightly divaricated fashion in order to facilitate entry of the tab 4.

When the tab 4 is inserted, the teeth 22 and 32 of the corresponding pins penetrate the polystyrene container and the rib 23 clashes with the rib 47 on the tab 4, securing it and preventing it from moving upwards.

When a worker has to close the container, they position the pins 2 and 3 in the seat and, after arranging the products to be transported inside the container, place the lid in position and insert the tab.

Figure 11:
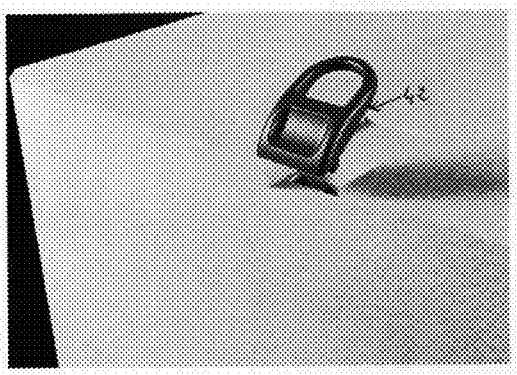
FIG. 11 shows an opening phase of the container in FIG. 10.
Figure 12:
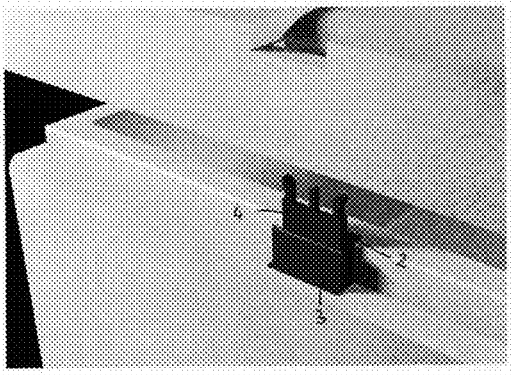
FIG. 12 shows an opening phase of the lid in FIG. 11.

When the recipient has to open the container, they simply need to force the handgrip 42 and, using the slot 46, rotate the grip 42 until the pins 43 and 44 break, as shown in FIGS. 11 and 12. In this way, it is possible to remove the lid and open the container.

In accordance with the present invention, the sealing mechanism for packaging containers in question comprises a second sealing mechanism which is particularly suitable for containers which have thicker walls, i.e. those classed as 'high-coefficient'.

Figure 5:
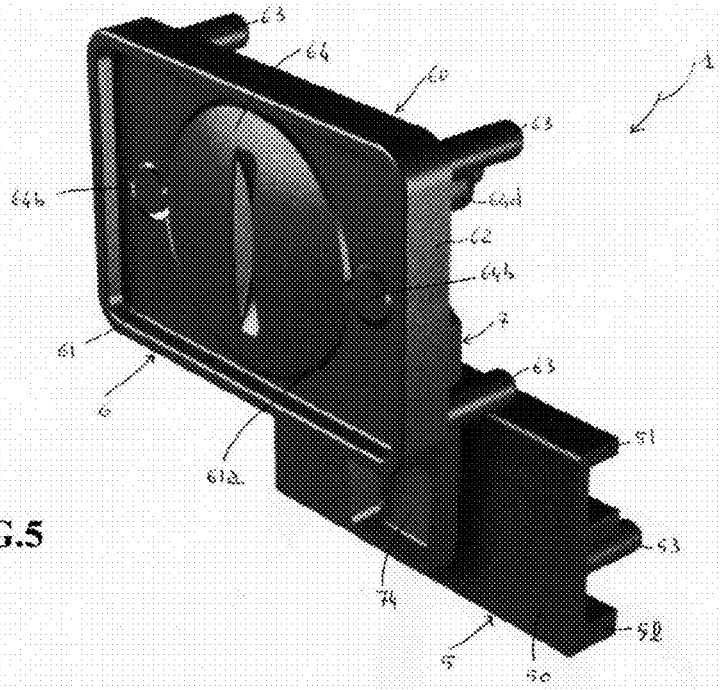
FIG. 5 shows a perspective view of a second sealing mechanism according to the present invention in the operating condition.
Figure 6:
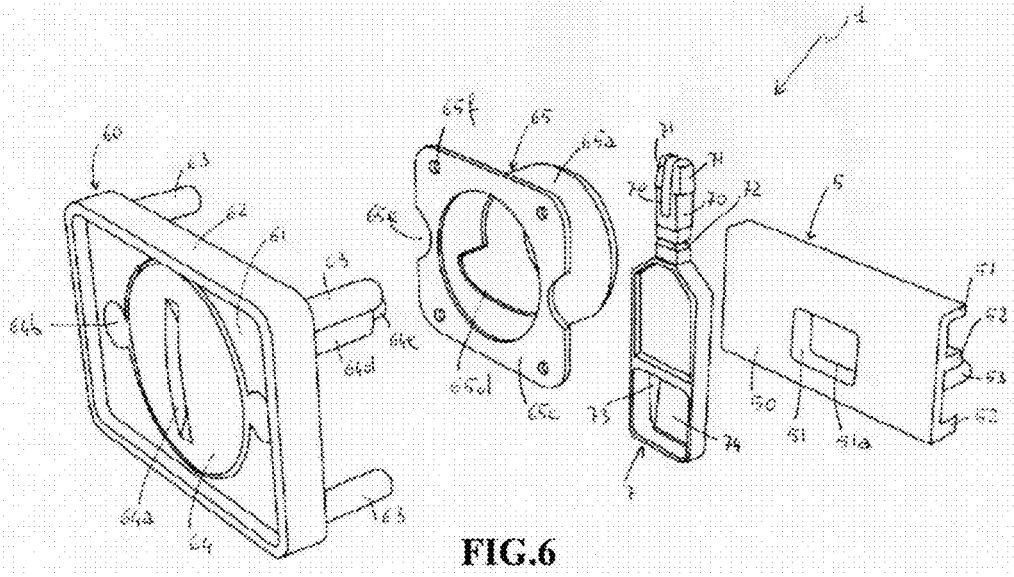
FIG. 6 shows a perspective and exploded view of the mechanism in FIG. 5.
Figure 7:
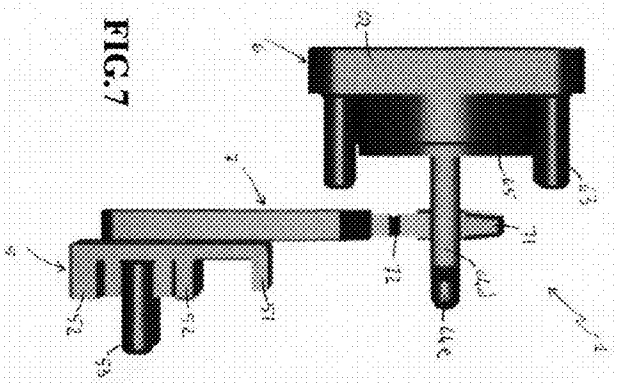
FIG. 7 shows a side view of the assembly of the components of the second mechanism according to the system in question.

The second mechanism, shown in FIG. 5, essentially consists of a first component 5, which is designed to be inserted in a specific seat in the container, a second component 6 designed to engage with the container lid, and a third component 7 envisaged to engage with the first component and the second, securing the entire mechanism as will be illustrated later on.

In particular, the first component 5 is essentially composed of a plate 50 whose rear side features an orthogonal edge 51 on one side and a H-shaped projection 52 on the opposite side, and in each space created inside the H-shaped projection there is a peg 53. In more detail, the rear side of the plate 50 is designed to abut with the wall of the container, at which point both the edge 51 and the pegs 53, as well as the H-shaped projection 52 enter the polystyrene of the container.

Moreover, the first component 5 features, on the other side of the plate 50, a recess 51 envisaged to offer a compartment for exerting pressure when it must be positioned in the suitable seat of the container, so that the pair of pegs fits into the structure of the polystyrene, but above all into an engagement space for the third component.

In particular, in the recess 51, there is a rib 51*a* envisaged, which has the task of creating an impediment, as will be better illustrated later.

The second component 6 is composed of two elements: an opening block 60 and a fitting 65.

In particular, the opening block 60 is composed of a sheet 61, surrounded by a peripheral edge which protrudes slightly on both faces 62 and in each corner there is a pin 63 envisaged to penetrate the polystyrene of the container when the block is positioned in the seat therefor in the lid. In more detail, the pins 63 retain the block 60 within the polystyrene but their primary function is a positioning one, as the actual sealing function is performed by the fitting 65.

In addition, the sheet 61 features, at the centre thereof, a button 64 endowed with a central groove 64*a* positioned along the diagonal used in the mechanism and container opening phase. The button 64 features, on the edge thereof and diametrically opposite with respect to the groove, a pair of small lugs 64*b* having the function of guarantee seals, allowing the end user to see whether or not there has been any attempt to open the container during transportation.

Figure 9:
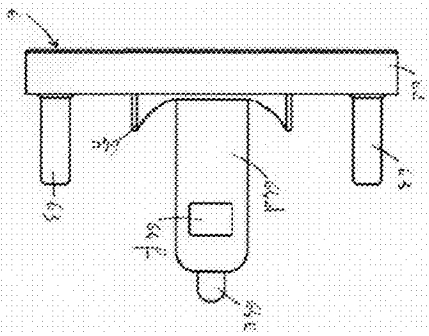
FIG. 9 shows a top view of a component of the second mechanism in FIG. 5.
Figure 8:
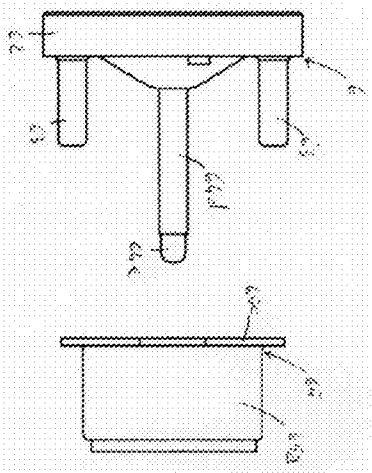
FIG. 8 shows an exploded side view of the components of the second mechanism in FIG. 5.
Figure 8:
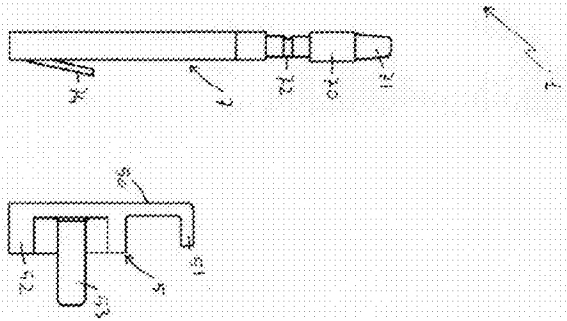

Furthermore, on the inner side, the button 64 has a relief 64*c* with an upper edge shaped so as to couple, in an obligatory fashion, with a corresponding profile 65*d* present in the fitting 65. Finally, as shown in FIG. 9, also on the inner side, the button 64 is endowed with an element 64*d*, which projects out from the said button in a perpendicular fashion and is provided with a tip 64*e*, at the free end, and a slot 64*f*, just below the tip, envisaged to accommodate and engage with the third component 7.

In the present embodiment, the button 64 is essentially detached from the sheet 61 except for at least one junction point 61*a*. In the embodiment illustrated, there are three junction points 61*a*.

In addition to the explanations so far, the sheet 61 features, on the inner part thereof, four projections envisaged to fit into corresponding holes 65*f* in the fitting 65.

The fitting 65 consists of a ring 65*a* which features an edge 65*c* which is orthogonal to the ring. In detail, the edge 65*c* is shaped and features a pair of loops 65*e* placed therebetween in a diametrically opposed fashion and positioned in correspondence with the small lugs 64*b* on the button 64 and the four holes 65*f*, which engage with the corresponding projections present in the sheet 61.

Finally, the third component 7 consists of a pin which features, at one end thereof, a pair of tips 70 placed therebetween in a parallel fashion and each provided with an enlargement 71 facing towards the exterior. In particular, the tips 70 are envisaged to be inserted into the slot 64*e* and the enlargements 71 are envisaged to engage, in an unremovable manner, the third component 7 with the second component 6.

In addition, the third component 7 has a recess 72 positioned in the vicinity of the tips 70 which is envisaged to facilitate the breakage of the said tips when a user has to open the container.

Finally, the third component 7 comprises, on the side opposite the tips 70, an opening 73 in which a tab 74 is present, which is slightly divaricated towards the exterior and is envisaged to engage with the recess 51 in the first component 5, engaging in particular with the rib 51*a* which prevents the tab itself going back and releasing when the container is closed with a lid. In this way, the tab 74 is securely locked.

Figure 14:
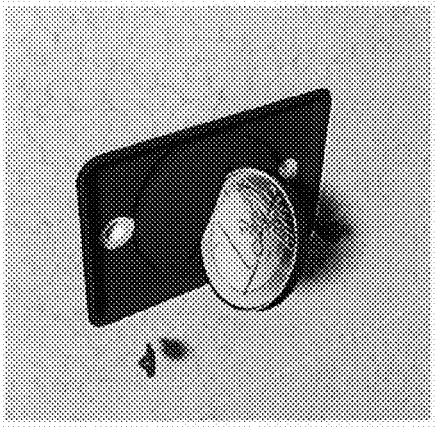
FIGS. 14 and 15 show two moments during the opening of the container in FIG. 13.
Figure 15:
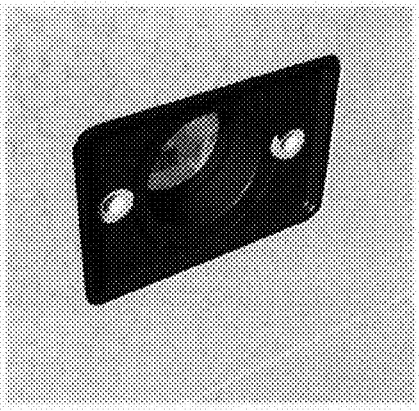

When the button 64 is rotated, as shown in FIG. 14, the two small lugs 64*b* which act as guarantee seals break, which means the white of the underlying polystyrene can be seen and the end user will know that the container has undergone tampering in the form of an attempt to restore or replace the mechanism. Furthermore, when the lugs 64*b* are detached, the button 64 also detaches from the sheet 61 because the junction points 61*a* break and as the fitting 65 rotates, the button comes out consequently breaking the tips 70 also, as shown in FIG. 15.

Once the container has been closed it can no longer be opened, except by breaking the mechanism.

In fact, the sealing mechanism in question, which can also be made—as in this case—of crystal polystyrene, is disposable, while the container can be reused several times but without the possibility of sealing with a second mechanism.

In accordance with the present invention, the mechanism 1 is also supplied in kit version for subsequent container use. In particular, the spare sealing mechanisms are a different colour and are numbered to prevent illegal openings and to allow monitoring of the number of uses and openings of the container, in order to have indirect traceability of these operations. In fact, frequent replacement of the mechanism becomes an alarm signal to prompt the end user to investigate as to what has happened to the container during transport. In particular, the change of the mechanism's colour shows that, at some stage, the container has been opened.

In more detail, at first use of the container, it is envisaged that the container will be supplied already equipped with the sealing mechanism.

Figure 13:
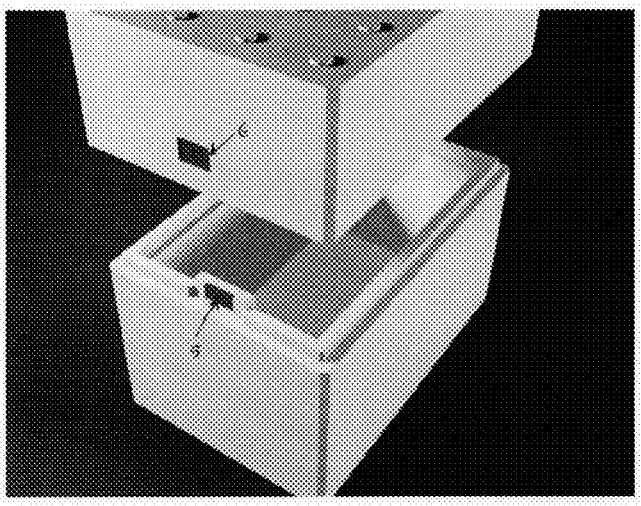
FIG. 13 shows the sealing phase of a container equipped with the mechanism in FIG. 5.

The worker, after completing the stage in which the container is filled with the products, drugs or otherwise, simply has to put the lid on the container, since it is ready for use, as shown in FIG. 13.

If the person who uses the container (e.g. the pharmaceutical logistics worker) accidentally closes it or realises that they have not completed the filling stage correctly and therefore it is necessary to open it, they will break the mechanism and replace it with one from the kit supplied, which will be a different colour and will be numbered, which means it is possible to monitor whether a container has been opened.

In the event of opening, the worker must insert the first and the second component of the mechanism into the appropriate seats. In fact, when the lid is positioned, the tab 74 will be inserted into the recess 51 in the first component 5, securing the lid to the container.

Also, when the logistics worker replaces the mechanism, they apply a sticker showing that the opening was performed at the origin, by the assembler and within the logistics company, and therefor in a monitored situation.

To open the container, the recipient has to turn the button 64 clockwise or anticlockwise until the junction points 61*a* break. With the rotation of the button 64, in addition to detaching it from the sheet 60, the user also exerts a torsion action on the tips 70, which are engaged with the slot 64*e* and whose movement is impaired by the enlargements 71, resulting in the snapping of the third component 7 in correspondence with the recess 72. When the button is rotated, the fitting 65 moves towards the exterior, extracting the said button.

As mentioned previously, the recipient, when opening the container, breaks the mechanism, which means they will dispose of both items, or possibly they can reuse the container but not close it with a sealing mechanism as this is not provided. Otherwise it would be more difficult to monitor the stages through which the container passes during its operational life.

Finally, when both the containers and the sealing mechanism wear out and/or break they can be recovered, ground up, or briquetted and the resulting material can be reused for the production of other containers or used in other processes, which means there are no polluting materials lying around or to be disposed of.

In particular, the assembly of the mechanism on the container features no gluing, which means the materials are not contaminated and remain pure and so are completely and totally recyclable; in fact, they can be sent together to a grinder to be extruded, thus obtaining, for example, the commonly known black trays used by florists.

In more detail, each previously stated container equipped with the mechanism in question is preferably made of foamed polystyrene but can also be made of polypropylene or wood or cardboard, and in any case, any other material with similar usage features.

After the predominantly structural description above, the operation of the invention in question will now be outlined.

When it is necessary to transport products which need to be handled in a protected, secure, and stable manner, such as, for example, drugs, a user simply has to insert the packs of drugs into the various containers and, once the operation is complete, close the container. To close the container, they simply place the lid in position and, with the first mechanism, insert the tab 4 into the relative slot, allowing it to enter between the pins 2 and 3, while with the second mechanism, once the lid is positioned, the sealing is automatic because the tab 74 is autonomously secured by the rib 51*a* in the recess 51.

Thus the present invention achieves the aims set.

In fact, the sealing mechanism in question can allow optimal handling of containers containing drugs or delicate products in a secure, protected, and stable manner.

Advantageously, the sealing mechanism, as conceived, provides the end-user with a final means of monitoring whether the container has been tampered with or opened during transport, with the risk of deterioration of the products contained therein or the theft thereof, and has reached destination in the same condition as when it left, since the tab 4 or the button 64 must be intact. The fact that the button or the tab are intact, after transportation, is the equivalent to having a guarantee seal attesting to the fact that the container has not been touched.

In addition, the sealing mechanism ensures a good seal between the lid and the container, prevents the purloinment of the contents, and signals to the end user that the transportation has been carried out successfully. In fact, the presence of the mechanism—which breaks when the container is opened—is a guarantee since the mechanism cannot be replaced in a fraudulent manner as the replacement kits are a different colour to the original part and when the replacement is carried out, it is signalled, allowing effective monitoring of the process which the container is undergoing.

Advantageously, the mechanism according to the present invention offers simple and quick closing of the container, as well as excellent container maintenance conditions from an aesthetic and structural point of view, given that the mechanism does not wear and ruin the polystyrene of the container upon which it is placed.

Another advantage of the sealing mechanism in question is encountered both during the container fitting out stages, which are much faster, easier and safer, allowing the container to be sealed in a precise, clean and tidy manner, without losing features such as practicality, tightness and security, resulting in substantial savings in terms of time, labour, and materials, which are transformed into a curbing of costs.

In particular, the mechanism in question is simple and practical and ensures that the containers are not ruined, as often happens with the prior art technique of sealing by means of adhesive tape.

A further advantage of this mechanism is encountered in the fact that is prevents the need to dispose of the materials in a particular manner since the mechanisms are made of crystal polystyrene which is disposed of in the same way as the polystyrene containers. In fact, the containers can be reused, and when damaged they can be recycled, which means there are no materials left in circulation to be disposed of, with consequent savings in management costs.

A further but not final advantage of the present invention is that it proves remarkably easy to use and to manufacture and works well.

Naturally, further modifications or variants may be applied to the present invention while remaining within the scope of the invention that characterises it.

The invention claimed is:

1. A sealing mechanism of crystal polystyrene for packaging containers, comprising:

a first pin (2);

a second pin (3) configured to engage in a seat present on an edge of a container; and a tab (4) configured to fit into a space between the first and second pins, wherein:

the first pin (2) is composed of a plate (20) wherein, at one end, there is an edge (21), positioned orthogonal to the plate and envisaged to rest on an inner edge of the container and, at the other end, there is at least one tooth (22), with a wedge-shaped configuration, positioned on the same side as the edge (21) and envisaged to engage with the container, the second pin (3) is composed of a plate (30) wherein, at one end, there is at least one tooth (32) with a wedge-shaped configuration, envisaged to engage with the container and, at about one third of the plate (30), on the free end side, there is a lug (33), positioned transversely and arranged to rest on the outer edge of the container, and the tab (4) consists of a strip (40) which features, at one end, rounded corners (41) for smooth entry between the pins (2 and 3) and, at the other end, a handgrip (42), positioned orthogonally to the strip, envisaged to rest on a container lid and equipped, at the top, with a small loop (45) and a slot (46), envisaged to accommodate a user's finger when the container has to be opened.

2. The sealing mechanism for packaging containers according to claim 1, wherein the plate (20) of the first pin (2) has at least one rib (23) positioned transversally to the plate.

3. The sealing mechanism for packaging containers according to claim 1, wherein, in the tab (4), between the handgrip (42) and the strip (40), there is a rupture element composed of a central pin (43) and at least two lateral pins (44), featuring slightly tapered outer edges.

4. The sealing mechanism for packaging containers according to claim 1, wherein said tab (4) has at least one rib (47), positioned transversely to the strip, about a quarter of the way along the length on the side with the rounded corners (41), and envisaged to abut with the rib (23) on the first pin (2), the tab (4) being able to feature the rib (47) on one side or on both.

5. The sealing mechanism for packaging containers according to claim 1, wherein all the surfaces of the first pin (2), the second pin (3), and the tab (4) are rough to create friction when they are in contact with the walls of the container and also reciprocally.

6. The sealing mechanism for packaging containers according to claim 1, wherein the mechanism is configured for use with containers having thin walls and are defined as 'low-coefficient'.

7. The sealing mechanism for packaging containers according to claim 1, further comprising:

a first component (5), arranged to fit into a suitable seat present in a container; and a second component (6), arranged to engage with the container lid, and a third component (7), envisaged to engage with the first and second components, locking the entire mechanism, wherein:

the first component (5) is composed of a plate (50) which has an orthogonal edge (51) at the rear, on one side, while on the side opposite an H-shaped protuberance (52) and in each space created within the H-shaped protuberance, there is a peg (53), the rear side of the plate (50) being arranged to abut with the wall of the container, making both the edge (51) and the pegs (53), as well as the H-shaped protuberance (52), enter the container, while the plate (50) features, at the front thereof, a recess (51) endowed with a rib (51*a*), the second component (6) is composed of two elements: an opening block (60) and a fitting (65) wherein the opening block (60) is composed of a sheet (61) surrounded by a peripheral edge which protrudes slightly on both faces (62) and in each corner there is a pin (63) envisaged to penetrate the polystyrene of the container when the block is positioned in the seat thereof, the sheet (61) featuring, at the centre thereof, a button (64) endowed with a central groove (64*a*) positioned along the diagonal, which is used when the mechanism and container are open, and on the edge thereof, positioned diametrically opposite the groove, a pair of small lugs (64*b*), having the function of guarantee seals, and including, on the inner side, a relief (64*c*) with an upper edge shaped so as to couple, in an obligatory fashion, with a corresponding profile (65*d*) present in the fitting (65) and, also on the inner side, the button being endowed with an element (64*d*) which projects out from the button, in a perpendicular fashion, and is provided with a tip (64*e*), at the free end, and a slot (64*f*), just below the tip, envisaged to accommodate and engage with the third component (7), and the fitting (65) consists of a ring (65*a*) which features a shaped edge (65*c*), positioned orthogonal to the ring and provided with a couple of loops (65*e*) positioned between them, diametrically opposed and located in correspondence with the small lugs (64*b*) of the button (64), and the third component (7) consists of a pin which features, at one end, a pair of tips (70) positioned in a reciprocally parallel fashion and each provided with an enlargement (71) towards the outside, the tips being designed to be inserted in the slot (64*e*), while the enlargements (71) are envisaged to engage the third component (7) in an unmovable fashion with the second component (6), the third component (7) comprising, on the side opposite the tips (70), an opening (73) containing a tab (74), which is slightly splayed outwards and envisaged to enter the recess (51) in the first component (5) and engage with the rib (51*a*), which firmly locks the tab when the container is sealed with the lid.

8. The sealing mechanism for packaging containers according to claim 7, wherein the button (64) is essentially detached from the sheet (61) except for at least one junction point (61*a*).

9. The sealing mechanism for packaging containers according to claim 7, wherein the sheet (61), on the inner side, has four projections envisaged to fit into corresponding holes (65*f*) in the shaped edge (65*c*) of the fitting (65).

10. The sealing mechanism for packaging containers according to claim 7, wherein the third component (7) features a recess (72) located in proximity to the tips (70), provided to facilitate the rupture thereof when a user has to open the container.

11. The sealing mechanism for packaging containers according to claim 2, wherein the plate (30) of the second pin (3) has at least another rib positioned transversally to the plate (30) of the second pin (3).

* * * * *